US007522130B2

(12) United States Patent
Weitbruch et al.

(10) Patent No.: US 7,522,130 B2
(45) Date of Patent: Apr. 21, 2009

(54) PLASMA DISPLAY PANEL (PDP)—IMPROVEMENT OF DITHERING NOISE WHILE DISPLAYING LESS VIDEO LEVELS THAN REQUIRED

(75) Inventors: Sébastien Weitbruch, Mönchweiler (DE); Cédric Thébault, Villingen-Schwenningen (DE); Carlos Correa, Villingen-Schwenningen (DE)

(73) Assignee: Thomson Licensing, Boulogne Billancourt (FR)

( * ) Notice: Subject to any disclaimer, the term of this patent is extended or adjusted under 35 U.S.C. 154(b) by 873 days.

(21) Appl. No.: 10/646,183

(22) Filed: Aug. 22, 2003

(65) Prior Publication Data

US 2004/0036799 A1 Feb. 26, 2004

(30) Foreign Application Priority Data

Aug. 23, 2002 (EP) ..... 02090298

(51) Int. Cl.
*G09G 3/28* (2006.01)
*G09G 5/10* (2006.01)
*G09G 5/02* (2006.01)

(52) U.S. Cl. ..... 345/63; 345/690; 345/596

(58) Field of Classification Search ..... 345/41, 345/60, 63, 589, 596, 690–693; 348/403.1–407.1
See application file for complete search history.

(56) References Cited

U.S. PATENT DOCUMENTS

| | | | | |
|---|---|---|---|---|
| 5,371,515 | A * | 12/1994 | Wells et al. | 345/596 |
| 6,646,625 | B1 * | 11/2003 | Shigeta et al. | 345/63 |
| 2003/0052841 | A1 * | 3/2003 | Tanaka et al. | 345/63 |
| 2003/0174150 | A1 * | 9/2003 | Ohe et al. | 345/690 |

FOREIGN PATENT DOCUMENTS

| | | |
|---|---|---|
| WO | 0245062 | 9/2001 |
| WO | 0171702 | 6/2002 |

OTHER PUBLICATIONS

Search Report for European Patent Appln. 02090298.7 dated Jan. 23, 2003.

* cited by examiner

*Primary Examiner*—Sumati Lefkowitz
*Assistant Examiner*—Randal Willis
(74) *Attorney, Agent, or Firm*—Robert D. Shedd; Robert B. Levy

(57) ABSTRACT

In many cases it is not possible to reproduce enough video levels on a PDP due to timing issues or a specific solution against the false contour effect. In such cases dithering is used to render all required levels. In order to reduce the visibility of the dithering noise there is performed a common change of the sub-field organization together with a modification of the input video data through an appropriate transformation curve based on the human visual system luminance sensitivity (Weber-Fechner law).

10 Claims, 11 Drawing Sheets

PLASMA DISPLAY PANEL (PDP)—IMPROVEMENT OF DITHERING NOISE WHILE DISPLAYING LESS VIDEO LEVELS THAN REQUIRED

The present invention relates to a device and method for processing video picture data for display on a display device having a plurality of luminous elements corresponding to pixels of a video picture, wherein the brightness of each pixel is controlled by sub-field code words corresponding to a number of impulses for switching on and off the luminous elements, by dithering said video picture data and sub-field coding the dithered video picture data for displaying.

BACKGROUND OF THE INVENTION

The Plasma technology makes it possible to achieve flat color panel of large size (out of the CRT limitations) and with very limited depth without any viewing angle constraints. Referring to the last generation of European TV, a lot of work has been made to improve its picture quality. Consequently, a new technology like the Plasma one has to provide a picture quality as good or even better than standard TV technology. In order to display a video picture with a quality similar to the CRT, at least 8-bit video data is needed. In fact, more than 8 bits should be preferably be used to have a correct rendition of the low video levels because of the gammatization process that aims at reproducing the non-linear CRT behavior on a linear panel like plasma.

A Plasma Display Panel (PDP) utilizes a matrix array of discharge cells that could only be "ON" or "OFF". Also unlike a CRT or LCD in which gray levels are expressed by analog control of the light emission, a PDP controls the gray level by modulating the number of small light pulses per frame. This time-modulation will be integrated by the observer's eye over a period corresponding to the eye time response.

Today, a lot of methods exist for reproducing various video levels using the modulation of the light pulses per frame (PWM—Pulse Width Modulation). In some cases it is not possible to reproduce enough video levels due to timing issues, use of a specific solution against false contour effect, etc. In these cases, some dithering technique should be used to artificially render all required levels. The visibility of the dithering noise will be directly linked to the way the basic levels have been chosen.

Dithering per se is a well-known technique used to reduce the effects of quantisation noise due to a reduced number of displayed resolution bits. With dithering, some artificial levels are added in-between the existing video levels corresponding to the reduced number of displayed resolution bits. This improves the gray scale portrayal, but on the other hand adds high frequency, low amplitude dithering noise which is perceptible to the human viewer only at a small viewing distance.

An optimization of the dithering concept is able to strongly reduce its visibility as disclosed in the WO-A-01/71702.

Various reasons can lead to a lack of video levels in the gray level rendition on a plasma screen (or similar display based on PWM system-like (Pulse Width Modulation) light generation.

Some of the main reasons for a lack of level rendition are listed below:

- In case of simple binary coding (each sub-field corresponds to a bit) 8 sub-fields are required for an acceptable gray scale rendition. Nevertheless, for some single scan panels, the addressing speed is not fast enough to render 8 sub-fields in a given timeframe (20 ms in 50 Hz video sources (PAL, SECAM), 16.6 ms in 60 Hz video sources (NTSC), 13.3 ms in 75 Hz video sources, . . . ).
- For good response fidelity, specific sub-field organizations with a specific sub-field weight sequence are needed. For instance, a sub-field sequence growing slower than the Fibonacci sequence (1-1-2-3-5-8-13-21-34-55-89-144-233 . . . ) increases the response fidelity of the panel. In that case at least 12 sub-fields are required to achieve more than 255 different levels corresponding to 8-bit video. Even in case of a dual-scan panel, the addressing time is mainly too slow to have both a good coding and enough sustain time to provide a good contrast and a good peak-white enhancement.
- In order to completely suppress the PWM related artifacts known under the name "false contour effect", a new coding concept has been developed called "incremental code". Such a coding system does no more allow to have any sub-field switched OFF between two sub-fields switched ON. In that case, the number of video levels which can be rendered is equal to the number of sub-fields. Since it is not possible to dispose of 255 different sub-fields on a plasma display (around 122 ms needed for addressing only), it won't be possible via such a method to dispose of enough video levels.

In order to simplify the exposition, the last case will be used as an example for the further explanation. Obviously, the invention described in this document is however not limited to this concept.

The plasma cell has only two different states: a plasma cell can only be ON or OFF. Thus video levels are rendered by using a temporal modulation. The most efficient addressing scheme should be to address N times if the number of video levels to be created is equal to N. In case of an 8 bit video value, each cell should be addressable 256 times in a video frame! This however, is not technically possible since each addressing operation requires a lot of time (around 2 μs per line, i.e. 480 μs for the addressing of all lines in dual scan mode and 256*480 μs=122 ms for the maximum value of 256 operations, which is much more than the 20 ms available time in case of the 50 Hz display mode).

Then, there are two possibilities to render the information. The first one is to use a minimum of 8 SF (in case of an 8-bit video level representation) and the combination of these 8 SF is able to generate the 256 levels. Such a mode is illustrated in FIG. 1.

Each sub-field is divided into three parts: an addressing part, a sustain part and an erase part. The addressing period is used to address line per line the plasma cells by applying a writing voltage to those cells that shall be activated for light generation and is typical for PDPs. The sustain period is used as a period for lighting of written plasma cells by applying sustain pulses with a typical sustain voltage to all cells. Finally, the erase period is used for erasing the cell charges, thereby neutralizing the cells.

FIG. 2 presents the standard method used to generate all 256 video levels based on the 8 bit code from FIG. 1.

According to FIG. 3 the eye of the observer will integrate, over the duration of the image period, the various combinations of luminous emissions and by this recreate the various shades in the gray levels. In case of no motion (left side of FIG. 3), the integration axis will be perpendicular to the panel in the time direction. The observer will integrate information coming from the same pixel and will not detect any disturbances.

If the object is moving (right side of FIG. 3), the observer will follow this object from frame t to t+1. On a CRT, because the emission time is very short the eye will follow correctly the object even with a large movement. On a PDP, the emission time extends over the whole image period. With an object movement of 3 pixels per frame, the eye will integrate sub-fields coming from 3 different pixels. Unfortunately, if among these 3 pixels there is a transition, this integration can lead to the false contour as shown at the bottom of FIG. 3 on the right.

The second encoding possibility already mentioned before is to render only a limited number of levels but to choose these levels in order to never introduce any temporal disturbance. This code will be called "incremental code" because for any level B>A one will have codeB=codeA+C where C is a positive value. This coding obviously limits the number of video levels which can be generated to the number of addressing periods. However, with such a code there will never be one sub-field OFF between two consecutive sub-fields ON. Some optimized dithering or error diffusion techniques can help to compensate this lack of accuracy.

The main advantage of such a coding method is the suppression of any false contour effect since there are no more any discontinuities between two similar levels (e.g. 127/128) as it was the case with standard 8 bit coding. For that reason this mode is sometimes called NFC mode for No False Contour. On the other hand, such a mode requires dithering to dispose of enough video levels, which can introduce some disturbing noise.

FIG. 4 illustrates the generation of 256 levels with an incremental code based on 16 sub-fields and 4 bit dithering ($16\times2^4=256$). For this a spatio-temporal uncorrelation of the 16 available basic levels is used. This example based on 16 sub-fields will be used in the following in order to simplify the exposition.

FIG. 5 presents the case of a transition 127/128 rendered via this mode in case of movement. It shows that moving transitions between similar levels are no more a source of false contouring but lead to smooth transitions. FIG. 4 illustrates the incremental addressing mode without addressing period. A global addressing operation is performed at the beginning of a frame period, called global priming. This is followed by a selective erase operation in which the charge of only those cells is quenched that shall not produce light. All the other cells remain charged for the following sustain period. The selective erase operation is part of each sub-field. At the end of the frame period a global erase operation neutralizes all cells. FIG. 6 illustrates a possibility to implement the incremental coding scheme with 4 bit dithering.

A further important aspect is the implementation of a gamma correction. The CRT displays do not have a linear response to the beam intensity but rather a quadratic response. For that reason, the pictures sent to the display are pre-corrected in the studio or mostly already in the video camera itself so that the picture seen by the human eye respects the filmed picture. FIG. 7 illustrates this principle.

In the case of Plasma displays which have a linear response characteristic, the pre-correction made at the source level will degrade the observed picture which becomes unnatural as illustrated on FIG. 8. In order to suppress this problem, an artificial gamma operation made in a specific video-processing unit of the plasma display device will invert the pre-correction made at the source level. Normally the gamma correction is made in the plasma display unit directly before the encoding to sub-field level. This gamma operation leads to a destruction of low video levels if the output video data is limited to 8 bit resolution as illustrated on FIG. 9.

In the case of the incremental code, there is an opportunity to avoid such an effect. In fact, it is possible to implement the gamma function in the sub-field weights. It shall be assumed to dispose of 16 sub-fields following a gamma function ($\gamma=1.82$) from 0 to 255 with a dithering step of 16 (4 bit). In that case, for each of the 16 possible video values $V_n$, the value displayed should respect the following progression:

$$V_0 = 255\times\left(\frac{0\times16}{256}\right)^{1.82} = 0$$

$$V_1 = 255\times\left(\frac{1\times16}{256}\right)^{1.82} = 2$$

$$V_2 = 255\times\left(\frac{2\times16}{256}\right)^{1.82} = 6$$

$$V_3 = 255\times\left(\frac{3\times16}{256}\right)^{1.82} = 12$$

$$V_4 = 255\times\left(\frac{4\times16}{256}\right)^{1.82} = 20$$

$$V_5 = 255\times\left(\frac{5\times16}{256}\right)^{1.82} = 30$$

$$V_6 = 255\times\left(\frac{6\times16}{256}\right)^{1.82} = 42$$

$$V_7 = 255\times\left(\frac{7\times16}{256}\right)^{1.82} = 56$$

$$V_8 = 255\times\left(\frac{8\times16}{256}\right)^{1.82} = 72$$

$$V_9 = 255\times\left(\frac{9\times16}{256}\right)^{1.82} = 89$$

$$V_{10} = 255\times\left(\frac{10\times16}{256}\right)^{1.82} = 108$$

$$V_{11} = 255\times\left(\frac{11\times16}{256}\right)^{1.82} = 129$$

$$V_{12} = 255\times\left(\frac{12\times16}{256}\right)^{1.82} = 151$$

$$V_{13} = 255\times\left(\frac{13\times16}{256}\right)^{1.82} = 175$$

$$V_{14} = 255\times\left(\frac{14\times16}{256}\right)^{1.82} = 200$$

$$V_{15} = 255\times\left(\frac{15\times16}{256}\right)^{1.82} = 227$$

$$V_{16} = 255\times\left(\frac{16\times16}{256}\right)^{1.82} = 255$$

Thus, in the case of an incremental code, for each value B>A, codeB=codeA+C where C is positive. In that case the weights are easy to compute on the basis of the following formula: $V_{n+1}=V_n+SF_{n+1}$ for n>0. One obtains the following sub-field weights $SF_n=V_n-V_{n-1}$:

$SF_1=2-0=2$
$SF_2=6-2=4$
$SF_3=12-6=6$
$SF_4=20-12=8$
$SF_5=30-20=10$
$SF_6=42-30=12$
$SF_7=56-42=14$
$SF_8=72-56=16$
$SF_9=89-72=17$
$SF_{10}=108-89=19$
$SF_{11}=129-108=21$
$SF_{12}=151-129=22$
$SF_{13}=175-151=24$
$SF_{14}=200-175=25$
$SF_{15}=227-200=27$
$SF_{16}=255-227=28$

The accumulation of these weights follows a quadratic function (gamma=1.82) from 0 (no SF ON) up to 255 (all SF ON). FIG. 10 represents this encoding method. It shows that an optimized computation of the weights for an incremental code enables to take into account the gamma progression without the implementation of a specific gamma operation at video level. Obviously, in the present example, only the use of 4-bit dithering enables the generation of the 256 different perceived video levels.

If nothing specific is implemented, each of the 16 sub-fields will be used to render a group of 16 video levels. FIG. 11 illustrates this principle. It represents how the various video levels will be rendered in the example of an incremental code. All levels between 0 and 15 will be rendered while applying a dithering based on the sub-field $SF_0$ (0) and $SF_1$ (2). All the levels between 224 and 240 will be rendered while applying a dithering based on the sub- $$SF_{14}\left(\sum_{i=0}^{i=14} SF_i = 200\right) \text{ and } SF_{15}\left(\sum_{i=0}^{i=15} SF_i = 227\right).$$

In this presentation the black level is defined as $SF_0$ (weight=0). Of course, there is no extra sub-field $SF_0$ in the sub-field organization. The black level is simply be generated by not activating or deactivating all other sub-fields $SF_1$ to $SF_{16}$. An example: The input video level 12 should have the amplitude 1 after gammatization $(255\cdot(12/255)^{1.82}=1)$ and this could be rendered with the dithering shown in FIG. 12. Half of the pixels in a homogenous block will not be activated for light generation and half will be activated for light generation only with sub-field $SF_1$-having the weight "2". From frame to frame the dithering pattern is toggled as shown in FIG. 12. FIG. 12 represents a possible dithering used to render the video level 12 taking into account the gamma of 1.82 used to compute the weights.

On the other hand, if no specific adaptation is applied, exactly the same dithering will be used in order to render the video level 231 (213.5 after gamma) as shown in FIG. 13. It represents a possible dithering used to render the video level 231 taking into account the gamma of 1.82 used to compute the weights $(255\cdot(231/255)^{1.82}=213.5)$.

FIG. 12 and FIG. 13 have shown that the same kind of dithering (4-bit) has been used both for the low-level and the high level video range. Each of the 16 possible video levels are equally distributed among the 256 video levels and the same kind of dithering is applied in-between to render the other levels. On the other hand, this does not fit with the human perception of luminance. Indeed the eye is much more sensitive to noise in the low level than in the luminous areas.

SUMMARY OF THE INVENTION

In view of that it is an object of the present invention to provide a display device and a method which enables a reduction of the dithering visibility.

According to the present invention this object is solved by a method for processing video picture data for display on a display device having a plurality of luminous elements corresponding to pixels of a video picture, wherein the brightness of each pixel is controlled by sub-field code words corresponding to a number of impulses for switching on and off the luminous elements, by dithering said video picture data and sub-field coding said dithered video picture data for displaying, as well as transforming said video picture data according to a retinal function before dithering.

Furthermore, the above-mentioned object is solved by a Device for processing video picture data for display on a display device having a plurality of luminous elements corresponding to pixels of a video picture, comprising brightness controlling means with which the brightness of each pixel is controlled by at least one sub-field code word with which the luminous element/s are activated or inactivated for light output in small pulses corresponding to sub-fields in a video frame, including dithering means for dithering said video picture data and sub-field coding means for sub-field coding said dithered video picture data for displaying, characterized by transforming means for transforming said video picture data according to a retinal function before dithering.

Further advantageous embodiments are apparent from the dependent claims.

The advantage of the present invention is the reduction of the dithering visibility by a change of the sub-field organization together with a transformation of the video input values through an appropriate transformation curve based on the human visual system luminance sensitivity (Weber-Fechner law).

BRIEF DESCRIPTION OF THE DRAWINGS

Exemplary embodiments of the invention are illustrated in the drawings and are explained in more detail in the following description. The drawings are showing in.

DETAILED DESCRIPTION OF PREFERRED EMBODIMENTS

The present invention will be explained in further detail along with the following preferred embodiments.

For a better understanding of the present invention some physiological effects of the human visible sense are presented below.

Figure 1:
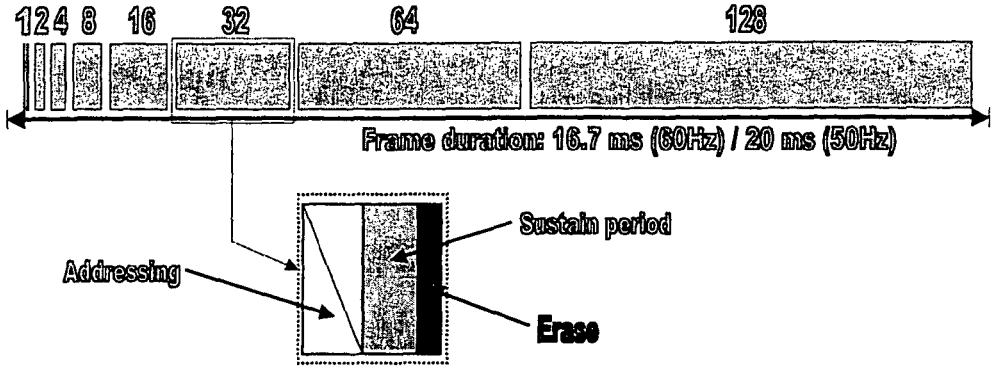
FIG. 1 the principle of 8-sub-field standard encoding.
Figure 2:
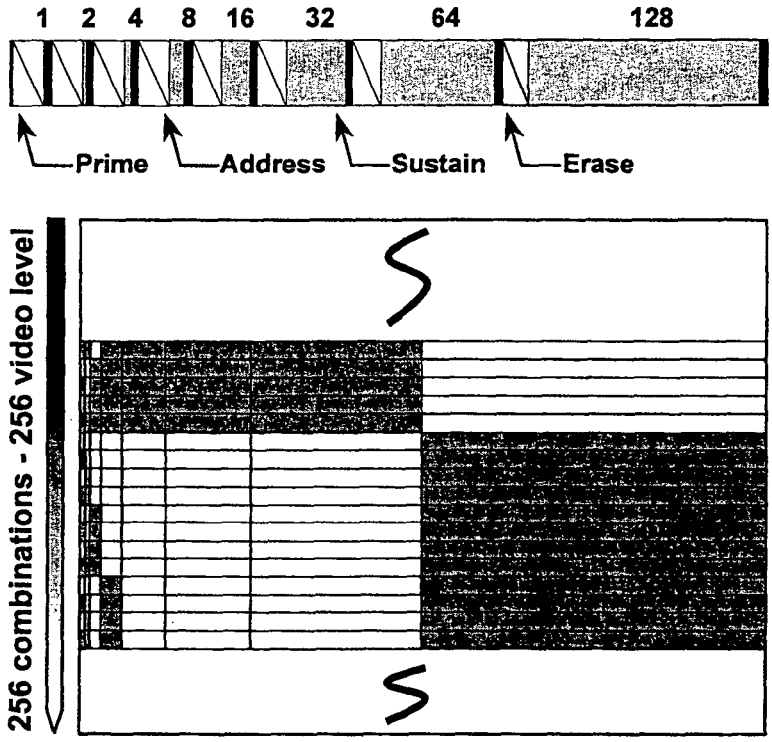
FIG. 2 the encoding of 256 video levels using standard approach.
Figure 3:
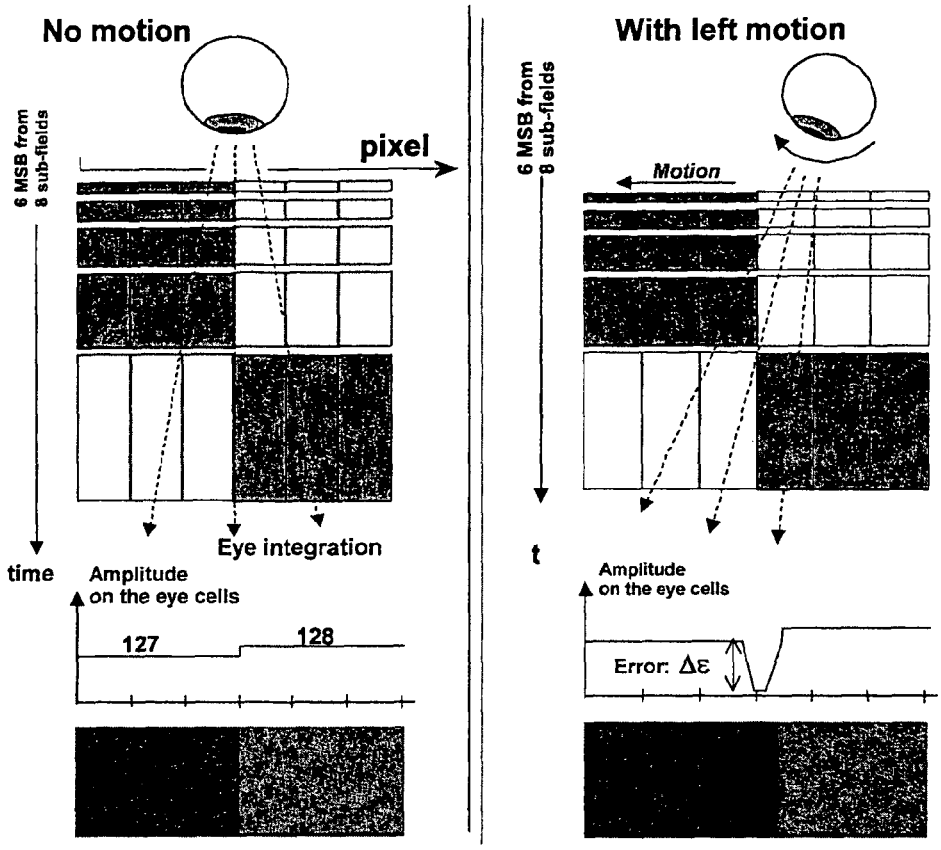
FIG. 3 the false contour effect in case of standard coding.
Figure 4:
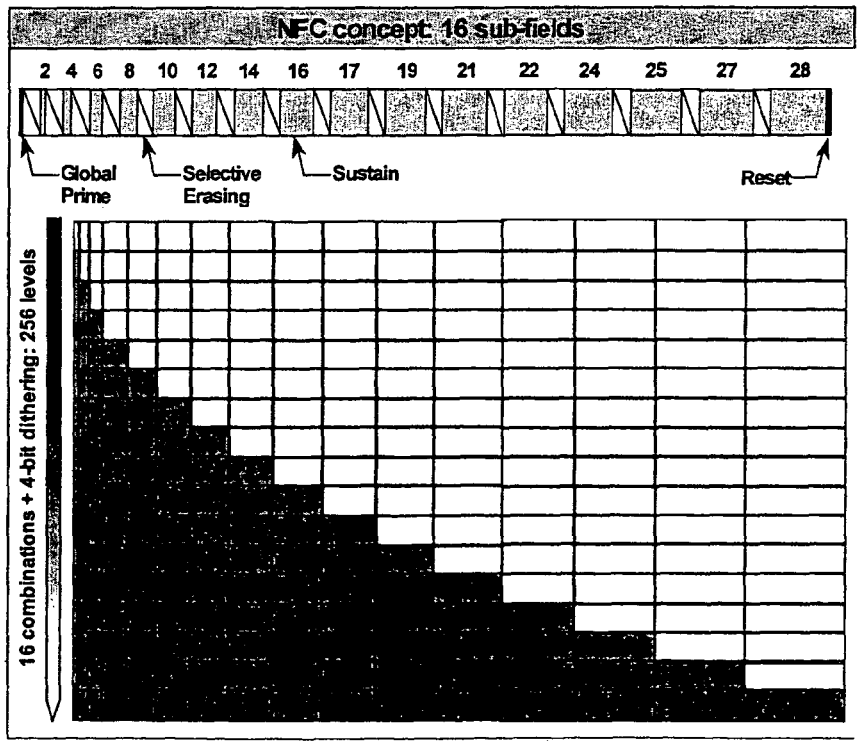
FIG. 4 the generation of 256 video levels with incremental coding.
Figure 5:
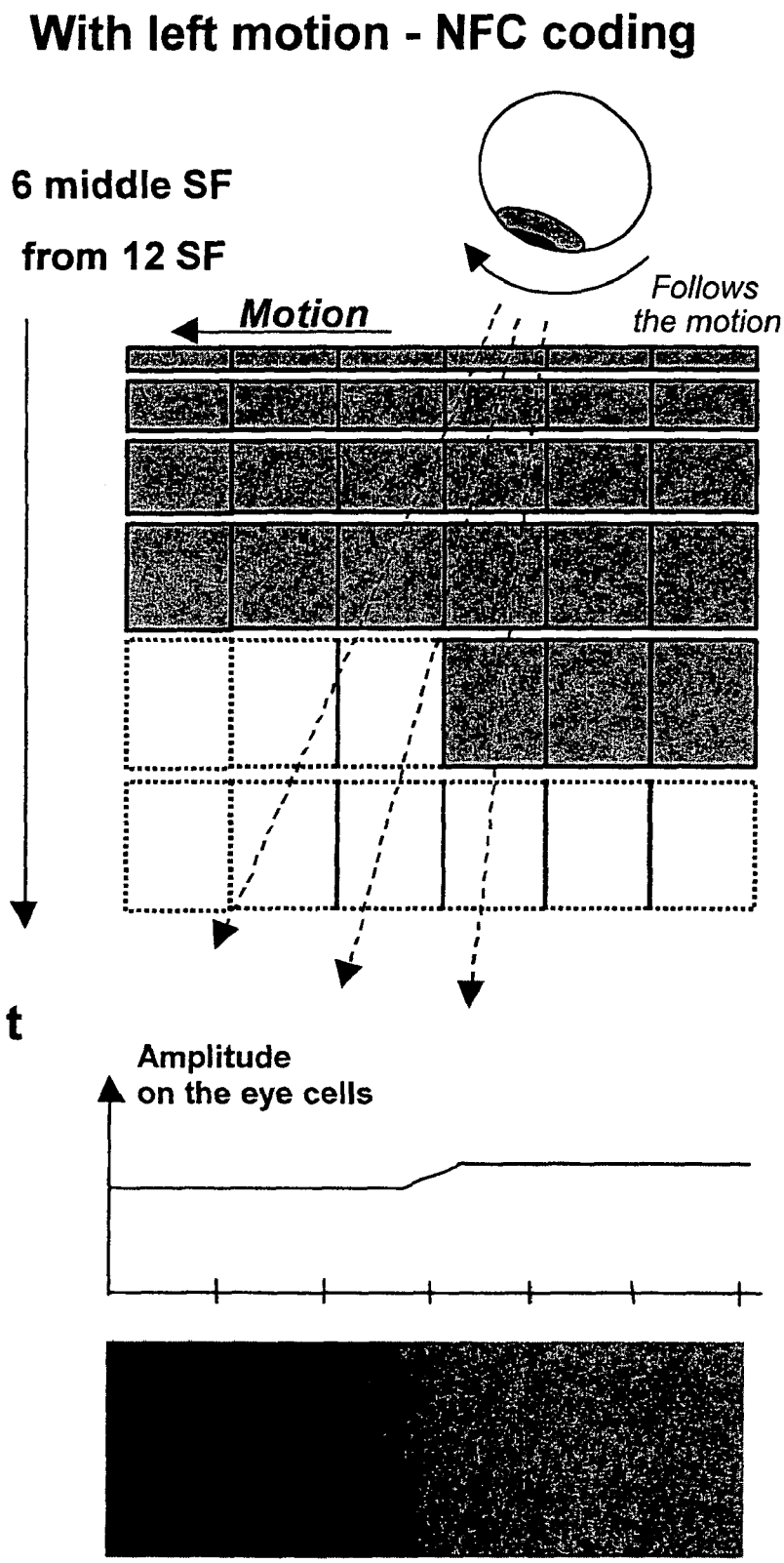
FIG. 5 a moving transition in case of incremental code.
Figure 6:
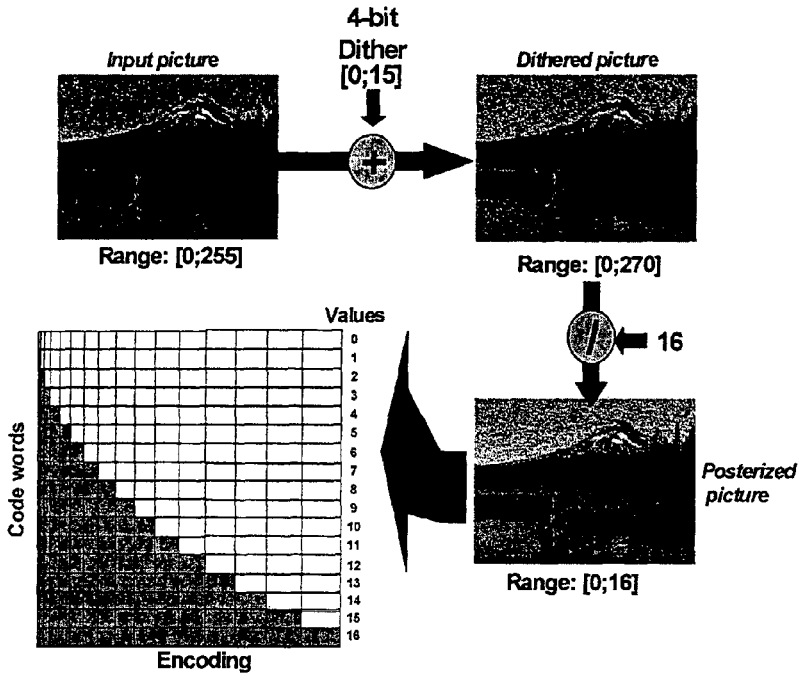
FIG. 6 principal processing steps for an implementation of the incremental coding.
Figure 7:
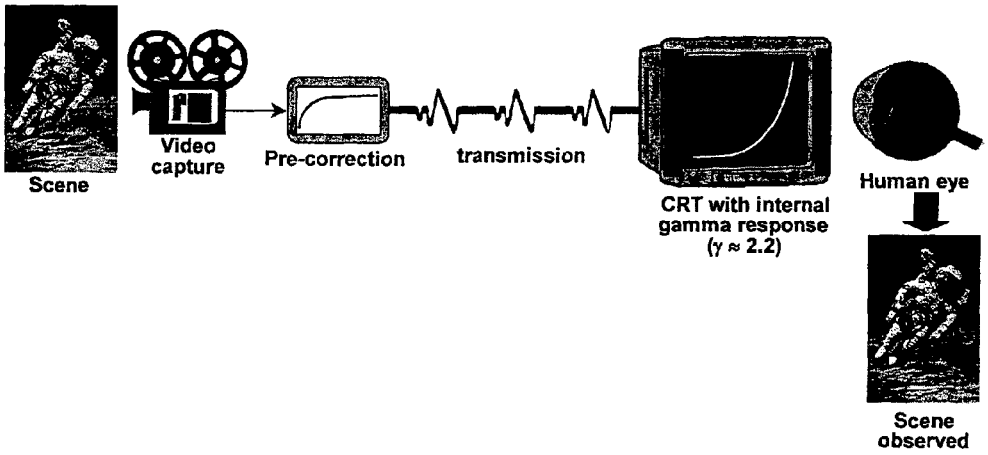
FIG. 7 the principle of gamma pre-correction for standard CRT displays.
Figure 8:
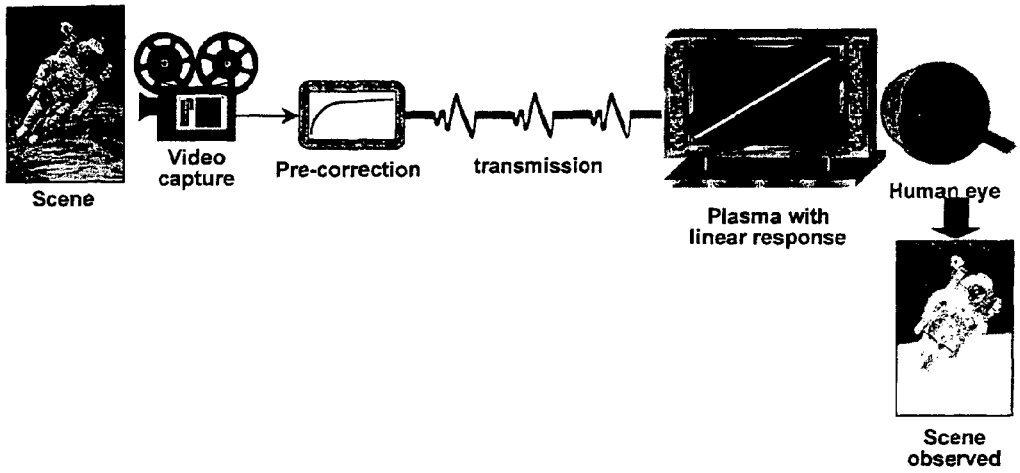
FIG. 8 the effect of displaying standard pre-corrected pictures on a PDP.
Figure 9:
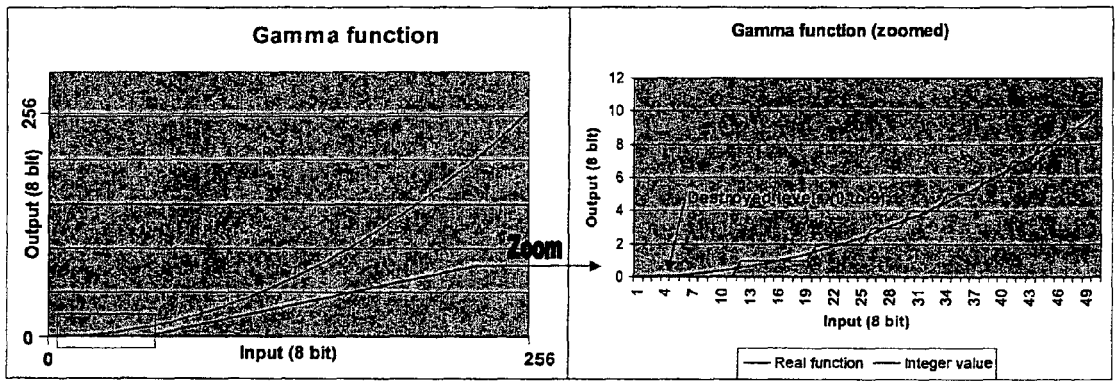
FIG. 9 the low video level destruction by application of a gamma function to the input video levels.
Figure 10:
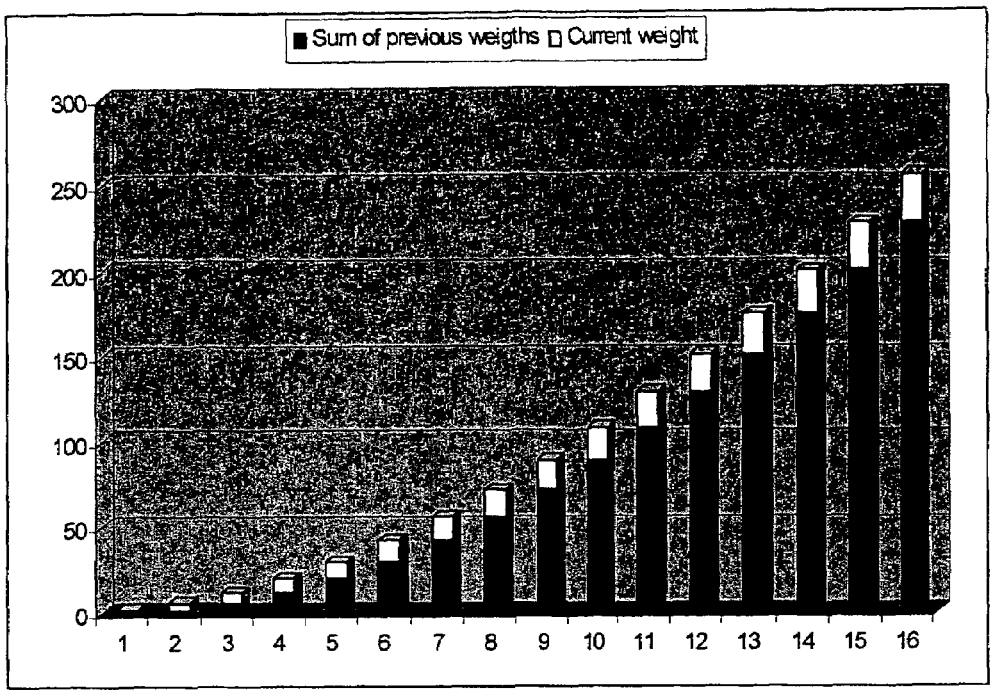
FIG. 10 a gamma progression integrated in the incremental coding.
Figure 11:
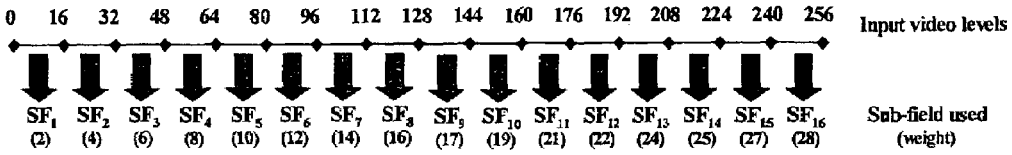
FIG. 11 a sub-field organization to be used for incremental coding.
Figure 12:
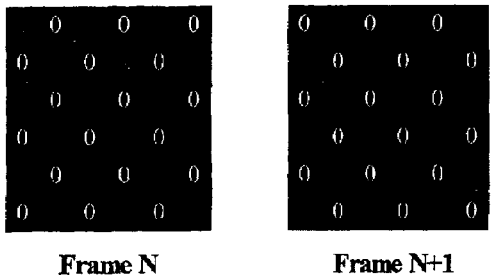
FIG. 12 a rendition of video level 12 with dithering.
Figure 13:
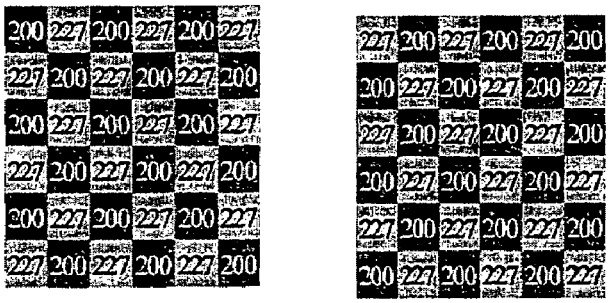
FIG. 13 a rendition of video level 231 with dithering.
Figure 14:
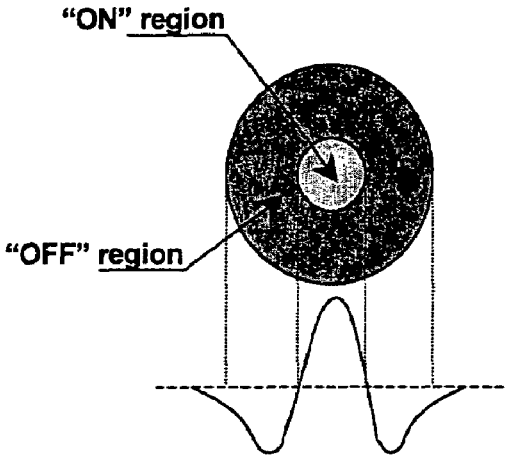
FIG. 14 a receptor field of a retina.
Figure 15:
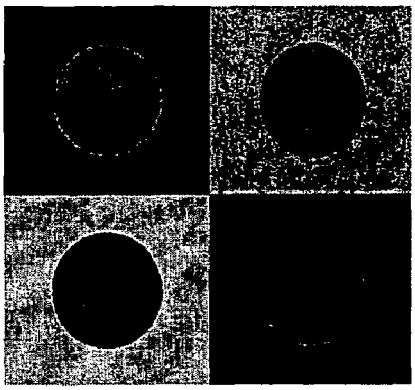
FIG. 15 an illustration for demonstrating the contrast sensitivity of human eyes.

The analysis of the retina shows one of the fundamental functions of the visual system cells: the notion of receptor fields. These represent small retina areas related to a neuron and determining its response to luminous stimuli. Such receptor fields can be divided into regions enabling the excitation or inhibition of the neuron and often called "ON" and "OFF" regions. FIG. 14 illustrates such a receptor field. These receptor fields transmit to the brain, not the absolute luminance value located at each photo-receiver, but the relative value measured between two adjacent points on the retina. This means that the eye is not sensitive to the absolute luminance but only to the local contrasts. This phenomenon is illustrated in FIG. 15: in the middle of each area, the gray disk has the same level, but human eyes perceive it differently.

This phenomenon is called "Weber-Fechner" law and represents retina sensitivity as a logarithmic behavior under the form $I_{eye}=\alpha_1+\alpha_2\cdot\log_{10}(I_{plasma})$. One formula commonly used is defined by Anil K. Jain in "Fundamental of digital image" (Prentice Hall 1989) under the form $$I_{eye} = \frac{I_{\max}}{2}\cdot\log_{10}\left(1+\frac{100\cdot I_{screen}}{I_{\max}}\right)$$

where $I_{screen}$ represents the luminance of the screen, $I_{max}$ the maximal screen luminance and $I_{eye}$ the luminance observed by the eye.

This curve shows that the human eye is much more sensitive to the low video levels than to the highest ones. Therefore, it is not reasonable to apply exactly the same kind of dithering for all video levels. If such a concept is used, the eye will be disturbed by the dithering applied to the lowest video levels while it does not care of all levels rendered in the luminous parts of the screen.

The inventive concept described in this document will take care of the human luminance sensitivity. In that case, the goal of the invention will be to apply less dithering to the low-levels while using more dithering for the high levels. In addition to that, this is done without using various dithering schemes by using a model of the human eye combined with an adaptation of the sub-field weighting.

The first stage defined in the inventive concept is based on a filtering of the input picture based on the human visual sensitivity function. In order to simplify the present exposition, a function will be used derived from those described above. Obviously, there are many other HVS functions existing and the invention shall not be limited to this particular function.

In the example, the function will be defined in the following form:

$$I_{out} = 423\cdot\log_{10}\left(1+\frac{3\times I_{\text{in}}}{255}\right)$$

when the luminance of the input picture is computed with 8-bit ($I_{max}$=255). Nevertheless, more precision can be used for computation (e.g. if various video functions are implemented before with a precision of 10-bit).

Figure 16:
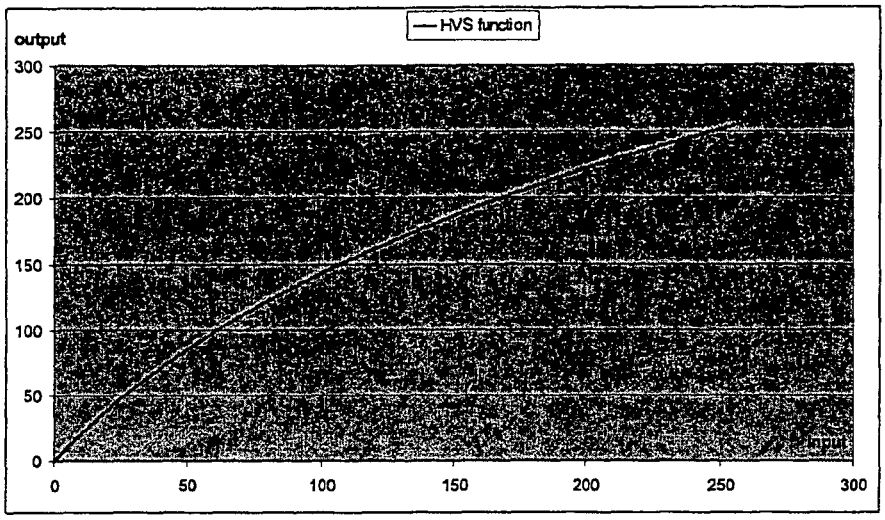
FIG. 16 an example of a HVS transformation curve.

The used transformation function presented in FIG. 16 can be applied via a LUT (Look-Up Table) or directly via a function in the plasma specific IC. The LUT is the simplest way and requires limited resources in an IC.

The next stage of the concept is the adapted modification of the picture coding with the sub-fields. Obviously, a complex transformation of the input picture corresponding to a retinal behavior has been applied and now, the inverse transformation should be applied in the sub-field weighting to present the correct picture to the eye (not twice the same retinal behavior).

As already said, the example of the incremental coding is again used to simplify the present exposition but any other coding concept can also be used for the invention.

In order to apply an inverse transformation in the weight, this inverse transformation should be computed.

Defining the retinal transformation as $$y = f(x) = 423\cdot\log_{10}\left(1+\frac{3\cdot x}{255}\right)$$

the inverse transformation is $$x = f^{-1}(y) = \frac{255}{3}\cdot\left(10^{\frac{y}{423}}-1\right).$$

As already said any other function $f(x)$ and $f^{-1}(y)$ could be used as long as it represents the retinal function and the inverse of the retinal function from the human eye.

Now, in order to compute the new sub-field weights for the incremental code, the inverse retinal function will be used. In the previous computation of the weights, the following formula has been used:

$$V_n = 255\cdot\left(\frac{n\cdot 16}{255}\right)^{\gamma}$$

with $V_n$ representing the progression of the weights, n the various steps of this progression (constant), 255 representing the maximum luminance, 16 the number of levels rendered with the dithering (4-bit) and $\gamma$ the gamma of 1.82. Now, this function shall be used further on but the sixteen steps n are no more in constant progression but they will have to follow the inverse retinal progression.

Therefore the steps will be computed with $$n' = g(n) = \frac{1}{16}\cdot f^{-1}(16\cdot n)$$

with the function f presented above $$f^{-1}(y) = \frac{255}{3}\cdot\left(10^{\frac{y}{423}}-1\right).$$

Then $$V_n' = 255 \cdot \left(\frac{n' \cdot 16}{255}\right)^{\gamma} = 255 \cdot \left(\frac{g(n) \cdot 16}{255}\right)^{\gamma} = 255 \cdot \left(\frac{f^{-1}(16 \cdot n)}{255}\right)^{\gamma} = 255 \cdot \left(\frac{10^{\frac{16 \cdot n}{423}} - 1}{3}\right)^{\gamma}$$

that leads to:

$V_0'=0$
$V_1'=1$
$V_2'=2$
$V_3'=4$
$V_4'=7$
$V_5'=11$
$V_6'=17$
$V_7'=25$
$V_8'=34$
$V_9'=47$
$V_{10}'=62$
$V_{11}'=81$
$V_{12}'=104$
$V_{13}'=131$
$V_{14}'=165$
$V_{15}'=206$
$V_{16}'=255$

In the case of an incremental code, one can see that for each value B>A, codeB=codeA+C where C is positive. In that case the weights are easy to compute since the following formula has to be respected: $V_{n+1}=V_n+SF_{n+1}$ for n>0. This leads to the following sub-field weights $SF_n=V_n-V_{n-1}$:

$SF_1=1-0=1$
$SF_2=2-1=1$
$SF_3=4-2=2$
$SF_4=7-4=3$
$SF_5=11-7=4$
$SF_6=17-11=6$
$SF_7=25-17=8$
$SF_8=34-25=9$
$SF_9=47-34=13$
$SF_{10}=62-47=15$
$SF_{11}=81-62=19$
$SF_{12}=104-81=23$
$SF_{13}=131-104=27$
$SF_{14}=165-131=34$
$SF_{15}=206-165=41$
$SF_{16}=255-206=49$

Figure 17:
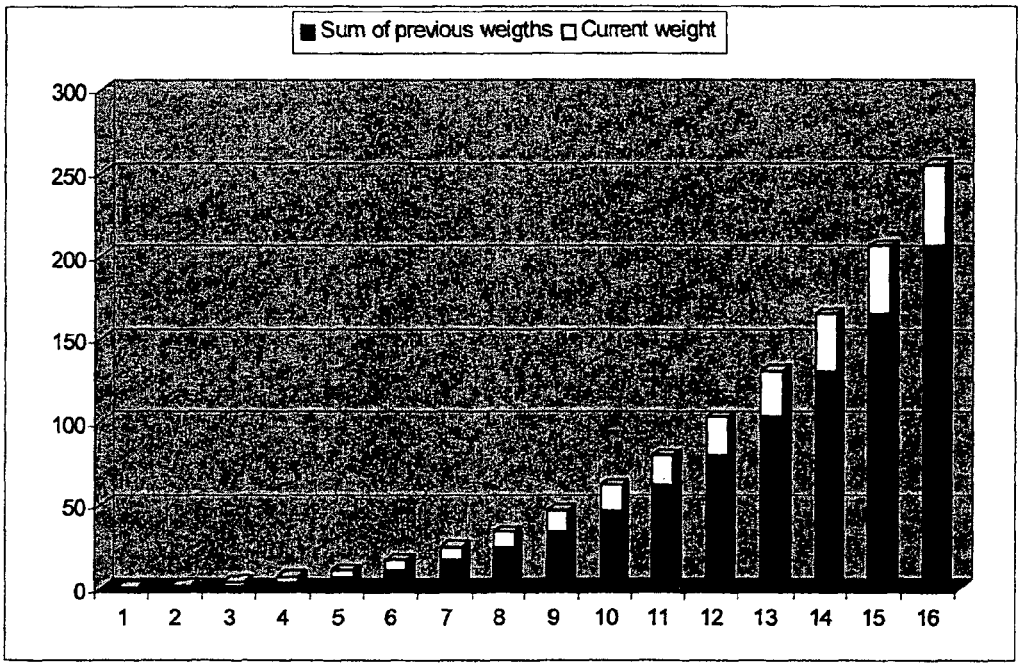
FIG. 17 an HVS adapted incremental coding scheme with integrated gamma progression.

Now, the new weights include not only the gamma function but also the inverse of retinal function, which has been applied to the input video values. The new sub-field progression is shown on FIG. 17.

Figure 18:
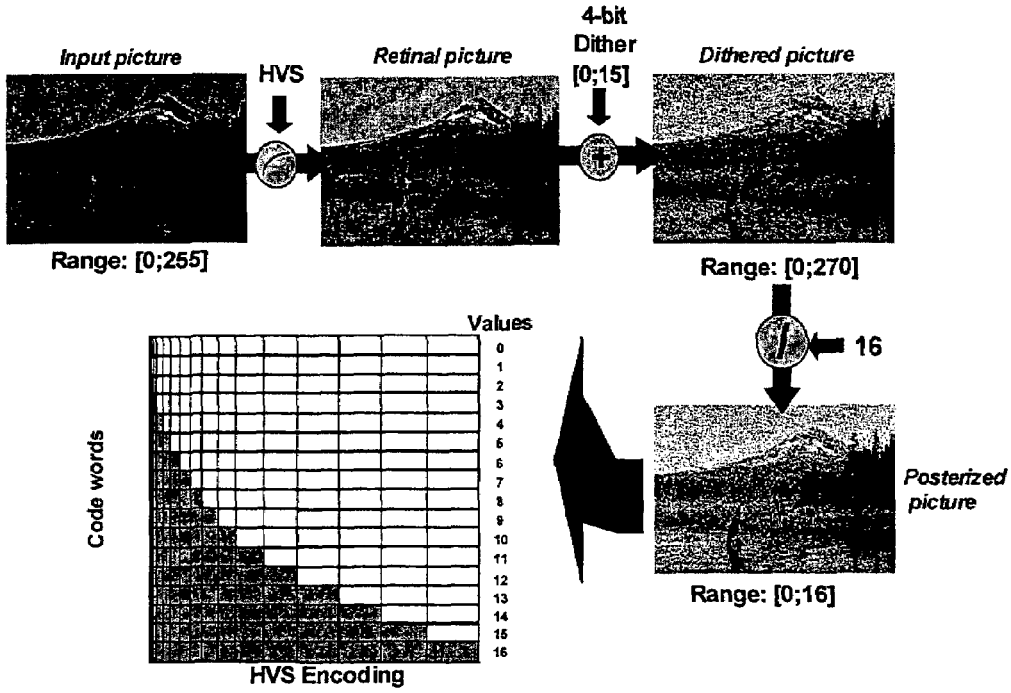
FIG. 18 principal processing steps for an implementation of the HVS adapted incremental coding scheme.

Based on this principle it is possible to use exactly the same implementation principle as described before and represented newly on FIG. 18. A HVS function is first applied to the input video level before the implementation of the dithering. The dithering is performed on the HVS adapted input picture. The inverse HVS function has been implemented integrated in the sub-field weighting to provide a correct picture to the eye including the required gamma function. Nevertheless, since the dithering function has been implemented between the HVS function and its inverse function, the dithering level will follow the HVS behavior as desired. Therefore, the dithering noise will have the same amplitude on the eye for all rendered levels and that makes it less disturbing.

Figure 19:
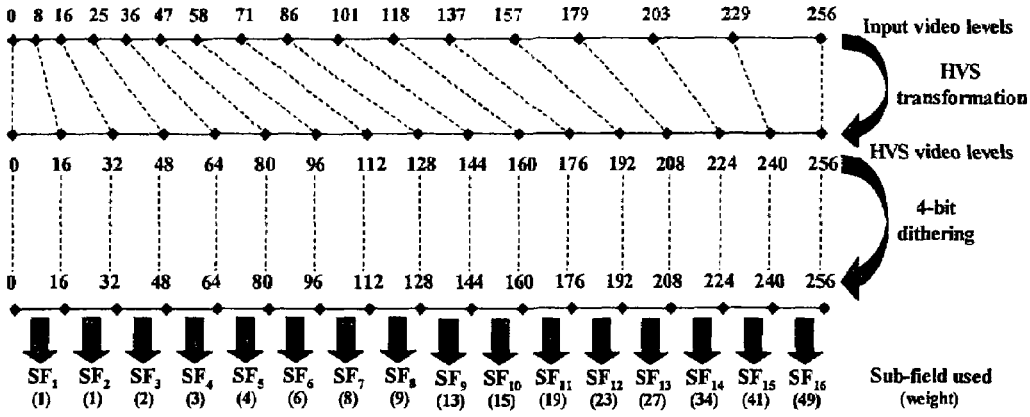
FIG. 19 the HVS coding concept and its effect on input video levels.

A further illustration of the whole concept is presented on FIG. 19. FIG. 19 depicts the result of the implementation of the HVS concept. In the low video levels an expansion has been made ahead of the dithering step. The low video levels are distributed over an enlarged video level range. This has the effect of a reduction of the dithering level. On the other hand, in the high video levels, a compression has been made ahead of the dithering step. The high video levels are concentrated in a reduced video level range. In that case the dithering level has been increased.

Figure 20:
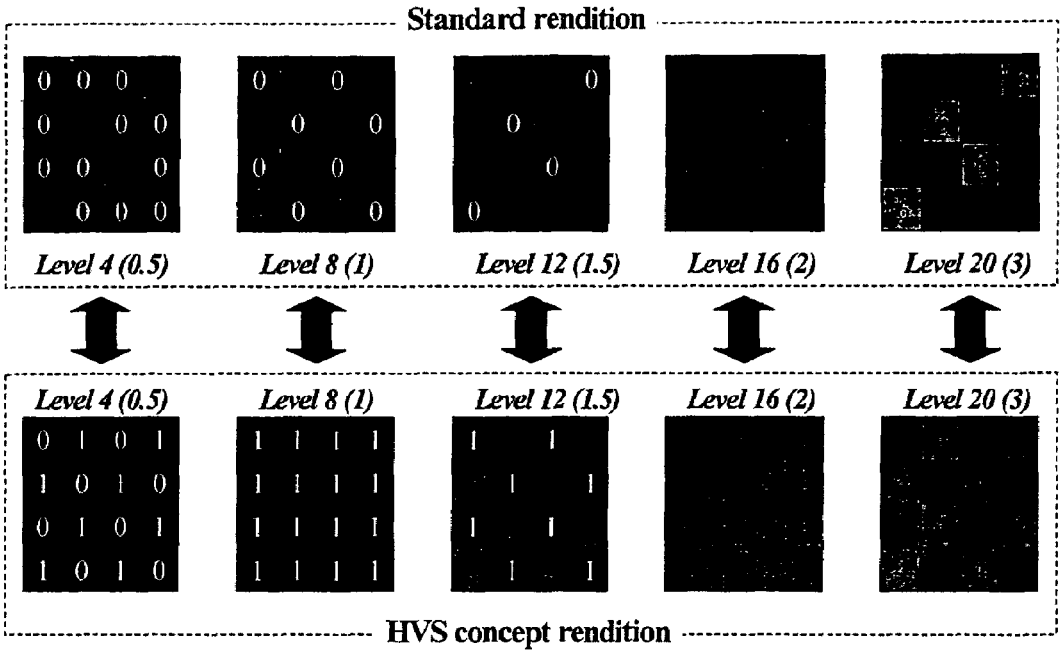
FIG. 20 a comparison of standard rendition and HVS rendition for some low video levels.
Figure 21:
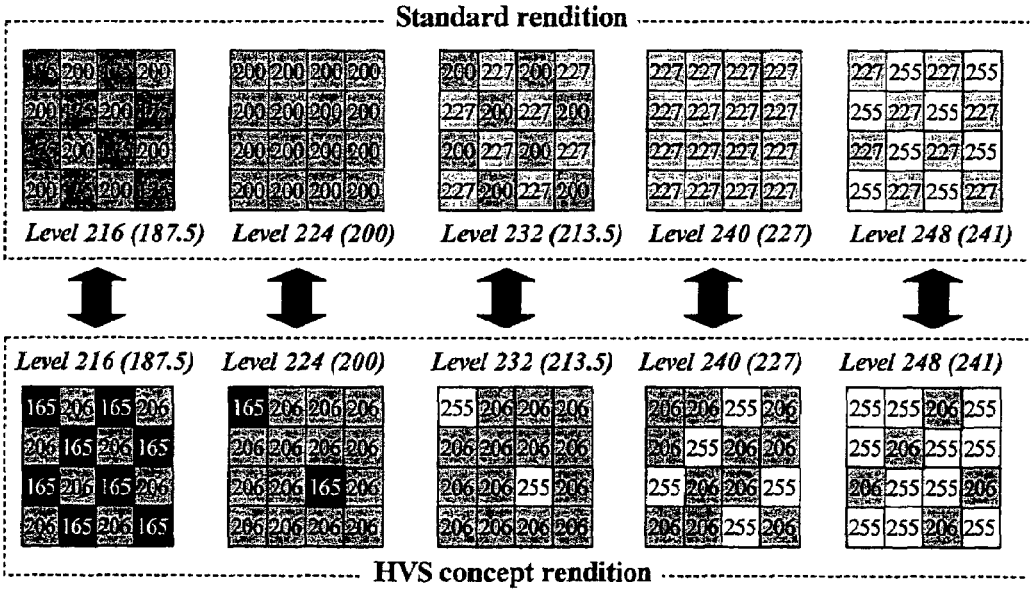
FIG. 21 a comparison of standard rendition and HVS rendition for some high video levels.

This can be better explained along with FIG. 20 and FIG. 21 which compare the rendition of various levels using the standard method (prior art) and the new HVS concept.

FIG. 20 shows the difference between the prior art and the new HVS concept in the rendition of low video levels. On the FIGS. 20 and 21, the values in brackets represent the value to be displayed after gammatization. In the HVS implementation, more sub-fields are available for low-level reproduction and therefore the dithering is less visible. For instance, the level 4 (0.5 after gammatization) is rendered with combination of 1 and 0 in case of HVS implementation. In that case, the dithering pattern is less visible than in the prior art solution with a combination of 0 and 2!

FIG. 21 now shows the difference between the prior art and the new HVS concept in rendition of high video levels. In the HVS implementation, there are fewer sub-fields available than in prior art since more sub-fields have been spent for low-levels. For instance the level 216 (187.5 after gammatization) is rendered with combination of 175 and 200 in case of prior art solution while a combination of 165 and 206 is used in HVS concept. Nevertheless, since the eye is less sensitive to high level differences, the picture is not really degraded in the high level range.

In other words the HVS concept therefore makes a compromise between more sub-fields for low-levels and less sub-fields for high levels in order to globally reduce the dithering visibility.

Figure 22:
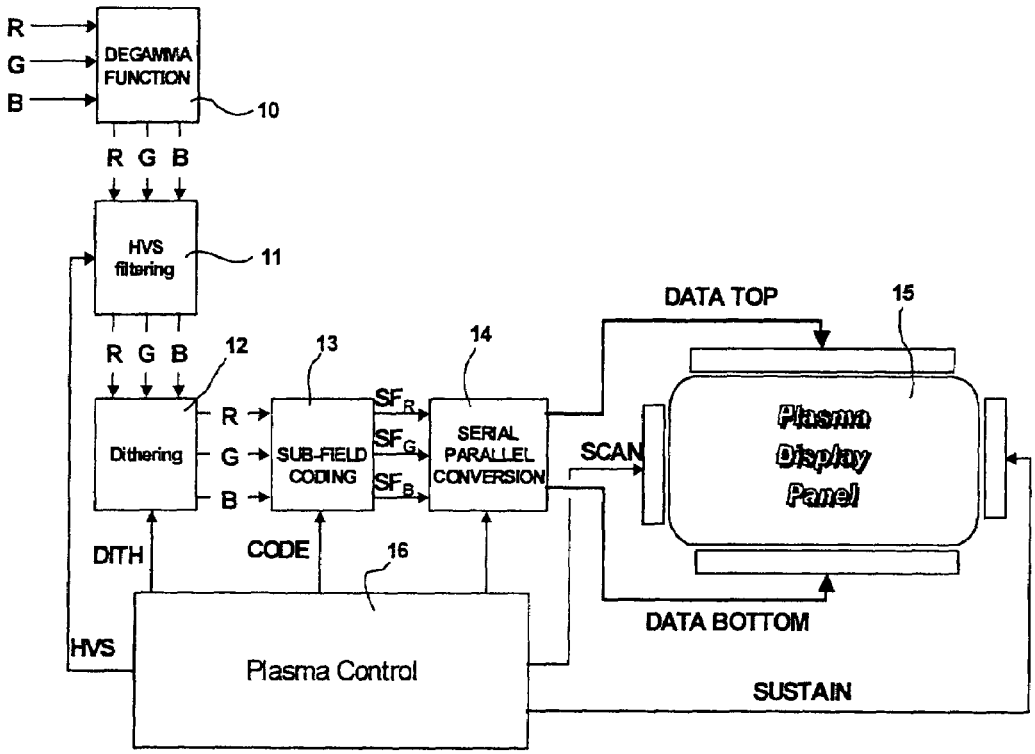
FIG. 22 a circuit implementation of HVS coding.

FIG. 22 describes a possible circuit implementation of the current invention. RGB input pictures are forwarded to the degamma function block 10: this can be realized with a lookup table (LUT) or by software with a mathematical function. The outputs of this block are forwarded to the HVS filtering block 11 that implements the retinal behavior via a complex mathematical formula or simply with a LUT. This function can be activated or deactivated by a HVS control signal generated by the Plasma Control block 16. Then the dithering will be added in dithering block 12 and this can be configured via the DITH signal from the Plasma Control Block 16.

The same block will configure the sub-field encoding block 13 to take into account or not the HVS inverse weighting.

For plasma display panel addressing, the sub-field code words are read out of the sub-field encoding block 13 and all the code words for one line are collected in order to create a single very long code word which can be used for the line-wise PDP addressing. This is carried out in the serial to parallel conversion unit 14. The plasma control block 16 generates all scan and sustain pulses for PDP control. It receives horizontal and vertical synchronising signals for reference timing.

The inventive method described in this document will enable a reduction of the dithering visibility by a common change of the sub-field organization together with a modification of the video through an appropriate transformation curve based on the human visual system luminance sensitivity (Weber-Fechner law).

In the preferred embodiments disclosed above, dithering was made pixel-based. In a colour PDP for each pixel three plasma cells RGB are existing. The invention is not restricted to pixel-based dithering. Cell-based dithering as explained in WO-A-01/71702 can also be used in connection with the present invention.

The invention can be used in particular in PDPs. Plasma displays are currently used in consumer electronics, e.g. for TV sets, and also as a monitor for computers. However, use of the invention is also appropriate for matrix displays where the light emission is also controlled with small pulse in sub-fields, i.e. where the PWM principle is used for controlling light emission. In particular it is applicable to DMDs (digital micro mirror devices).

What is claimed is:

1. Method for processing video picture data for display on a display device having a plurality of luminous elements corresponding to pixels of a video picture, wherein the brightness of each pixel is controlled by at least one sub-field code word with which the luminous element/s are activated or inactivated for light output in small pulses corresponding to sub-fields in a video frame, each sub-field having assigned a sub-field weight, the sub-field determining the length in time a pixel is activated during this sub-field, the method comprising the steps of:

dithering said video picture data and sub-field coding said dithered video picture data for brightness control, transforming said video picture data according to a non-linear function representing the Weber-Fechner-law before said dithering step and sub-field coding said dithered video picture data for brightness control, wherein in the step of sub-field coding a specific code is used in which by corresponding bit entries it is avoided that in a frame period a sub-field is inactivated between two activated sub-fields and wherein the sub-field weights are adapted to grow according to the Inverse of the non-linear function representing the Weber Fechner-law, thereby integrating the inverse transformation of the dithered video picture data in the step of sub-field coding.

2. Method according to claim 1, wherein said transforming step includes expanding low video levels of brightness and compressing high video levels of brightness.

3. Method according to claim 1, wherein said non-linear function is $y=\alpha\cdot\log_{10}(b+c\cdot x)$ where a, b, and c are real numbers.

4. Method according to claim 1 wherein said non-linear function is applied via a look-up table.

5. Method according to claim 1 wherein the dithering step has a characteristic that by using one sub-field, more video levels are rendered in the high video level range than in the low video level range.

6. Device for processing video picture data for display on a display device having a plurality of luminous elements corresponding to pixels of a video picture, comprising brightness controlling means with which the brightness of each pixel is controlled by at least one sub-field code word with which the luminous element/s are activated or inactivated for light output in small pulses corresponding sub-fields in a video frame, each sub-field having assigned a sub-field weight, the sub-field weight determining the length in time a pixel is activated during this sub-field, dithering means for dithering said video picture data, the dithering means including transforming means for transforming said video picture data according to a non-linear function representing the Weber- Fechner-law before dithering and sub-field coding means for sub-field coding said dithered video picture data for displaying specific code in which by corresponding bit entries it is avoided that in a frame period a sub-field is inactivated between two activated sub-fields, and wherein sub-field weights are adapted to grow according to the inverse of the non-linear function representing the Weber -Fechner-law, thereby integrating the inverse transformation of the dithered video picture data in the step of sub-field coding.

7. Apparatus according to claim 6 wherein said transforming means causes expansion of low video levels of brightness and compression of high video levels of brightness.

8. Apparatus according to claim 6, wherein said non-linear function for transforming input values to output values is $y=\alpha\cdot\log_{10}(b+c\cdot x)$ where a, b, and c are real numbers.

9. Apparatus according to claim 6 wherein said non-linear function is applied via a look-up table.

10. Apparatus according to claim 6 wherein the transforming means causes the dithering means step to render more video levels using one sub-field in the high video level range than in the low video level range.

* * * * *